US008029156B2

(12) United States Patent
Liou et al.

(10) Patent No.: US 8,029,156 B2
(45) Date of Patent: Oct. 4, 2011

(54) OPTICAL MODULE FOR LED ARRAY

(76) Inventors: Yuan-Chang Liou, Nantou (TW); Ching-Miao Lu, Taipei (TW)

( * ) Notice: Subject to any disclaimer, the term of this patent is extended or adjusted under 35 U.S.C. 154(b) by 274 days.

(21) Appl. No.: 12/141,065

(22) Filed: Jun. 17, 2008

(65) Prior Publication Data

US 2009/0310358 A1 Dec. 17, 2009

(51) Int. Cl.
*F21V 1/00* (2006.01)

(52) U.S. Cl. ..... 362/241; 362/243; 362/342

(58) Field of Classification Search ..... 362/609, 362/612, 613, 623, 241, 242, 243, 342
See application file for complete search history.

(56) References Cited

U.S. PATENT DOCUMENTS

2005/0047130 A1* 3/2005 Waters ..... 362/231
2005/0243576 A1* 11/2005 Park et al. ..... 362/612
2006/0245208 A1* 11/2006 Sakamoto et al. ..... 362/612
2008/0037279 A1* 2/2008 Chan ..... 362/612

* cited by examiner

*Primary Examiner* — John A Ward

(57) ABSTRACT

An optical module for LED luminaire is provided. The optical module can be used with LED arrays so that the luminaire with LED arrays can utilize the present invention to improve the luminance, brightness, luminance uniformity and coefficient of utilization to meet the user's demands. The optical module includes at least a radiation guiding unit and at least an anti-glare unit. The radiation guiding units are arranged abreast to adjust the radiation pattern to fit the coverage range. The anti-glare unit is formed on the both sides of the radiation guiding unit to prevent glare. The optical module of the present invention, when used in a luminaire, can form the expected distribution curve according to the objects to be lighted.

15 Claims, 10 Drawing Sheets

OPTICAL MODULE FOR LED ARRAY

FIELD OF THE INVENTION

The present invention generally relates to an optical module, and more specifically to an optical guiding module for an LED light source so as to improve the uniformity and adjust the radiation pattern according to the lighted target.

BACKGROUND OF THE INVENTION

The basic criteria for lighting design include illuminance, brightness, uniformity (lowest illuminance/average illuminance), coefficient of utilization (the flux received in the effective luminance range/the lighting source flux), luminaire efficacy (luminaire flux/light source flux), and so on. There is a trade-off between the coefficient of utilization and uniformity. It is a big challenge to improve high coefficient of utilization while to maintain the uniformity. How to reach a good balance between the coefficient of utilization and the uniformity remains a big task to the lighting designer.

Recently, the LED lighting is becoming popular. As the LED lighting has the advantages of eco-friendliness, high efficiency, low maintenance cost and long lifespan, the LED lighting will replace the conventional lighting source eventually, such as mercury lamp, incandescent lamp, halogen lamp. Since the single LED's flux is not sufficient for the luminance needed, an LED array with plurality of LEDs is needed. This type of LED light source has the following drawbacks:

1. Different lighted targets may require different second-order optical designs according to the distance from the light source (such as different height of the road), the shape of the lighted area, or the lighted space (different road width or distance between lamps). The suitable lighting distribution curve cannot be achieved by simply changing the LED array arrangement.
2. The LED light source usually uses a lamp casing as the second-order optical reflector; hence, it is difficult to form optimal radiation pattern.
3. LED's light radiation is directional, thus, the LED light source can easily generate glare and cause uniformity problem which makes the user uncomfortable.
4. The same LED chips may generate different radiation patterns because of the different packaging manner or packaged by different manufacturers. Therefore, the second-order optical design of the lighting device is restricted by the packaging manufacturer and the packaging method.

Therefore, the present invention provides an optical module which can guide the LED light radiation to the righted area with expected efficacy.

SUMMARY OF THE INVENTION

The primary object of the present invention provides an optical module which can adjust the radiation pattern to match the lighted target requirement, in the mean time, to maintain high uniformity and efficiency.

Another object of the present invention provides an optical module with high efficacy by using highly reflective material on reflector surfaces to reduce the flux decay to enhance efficacy.

To achieve the aforementioned objects, the present invention provides an optical module, including, at least, a light radiation guiding unit, and, at least an anti-glare unit. The plurality of light radiation guiding units is arranged abreast and includes a pair of opposite light guiding reflectors, $1^{st}$ and $2^{nd}$ reflectors. The $1^{st}$ light guiding reflector forms an angle $\theta_1$ from the center line of an LED row, the $2^{nd}$ light guiding reflector forms an angle $\theta_2$ from the center line of the LED row. The angle of $\theta_1$ and $\theta_2$ are within 0°-89°.

The anti-glare unit includes a pair of anti-glare light reflectors, crossed the light radiation guiding unit, and allocated on both sides of the light radiation guiding unit. The $1^{st}$ anti-glare light reflector forms an angle $\phi_1$ with the center line, and the $2^{nd}$ anti-glare light reflector forms an angle $\phi_2$ with the center line. Both $\phi_1$ and $\phi_2$ are within +89° to −89° with the center line. When the optical module of the present invention is applied to the LED array, the light beam from the LED array can be guided to the target area which leads to improve the coefficient of utilization.

For better understanding the foregoing object's features and advantages of the present invention, herein, provides the appropriate example accompany with drawings.

DETAILED DESCRIPTION OF THE PREFERRED EMBODIMENTS

Figure 1:
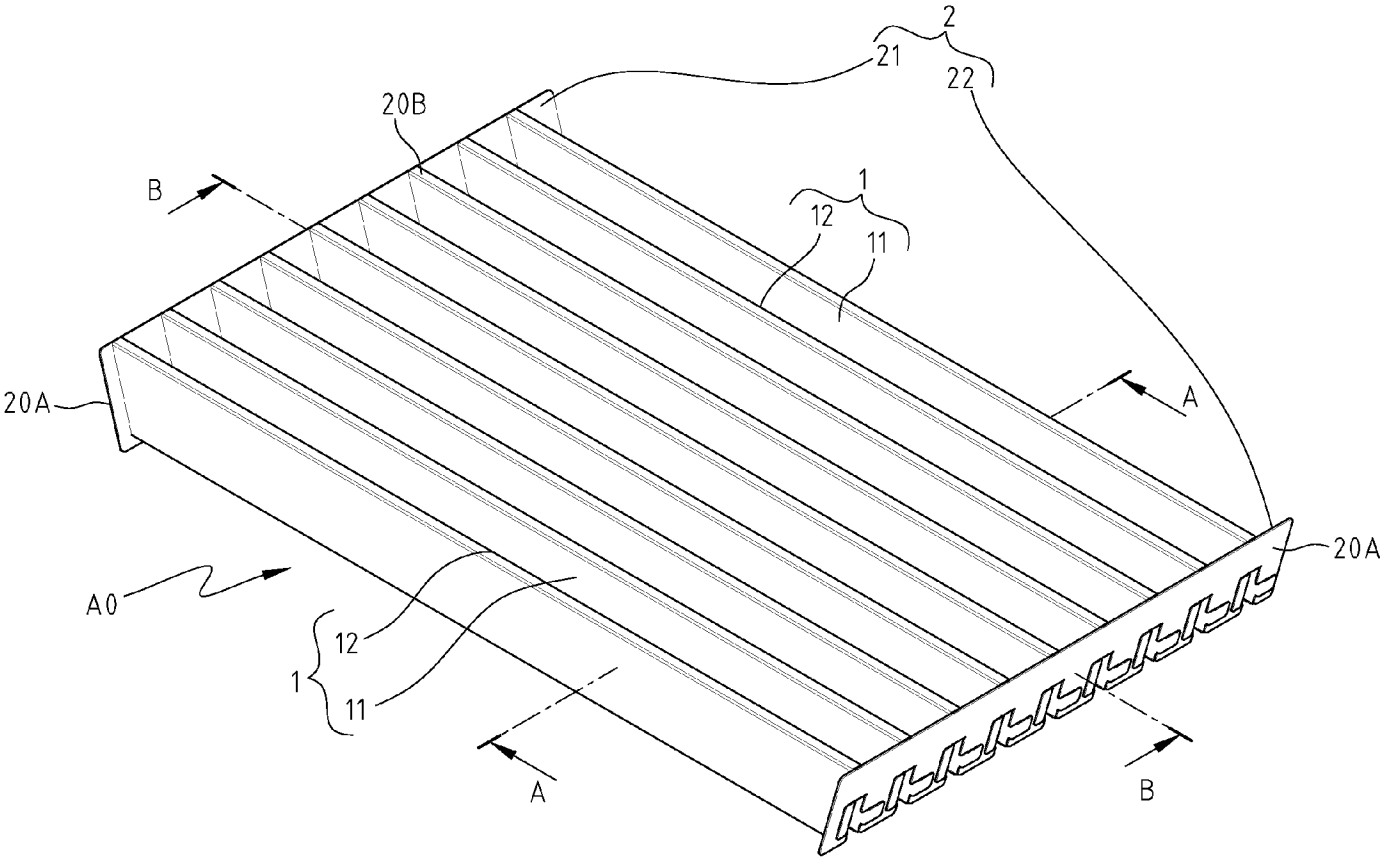
FIG. 1 shows a three-dimensional schematic view of the first embodiment according to the present invention.
Figure 2:
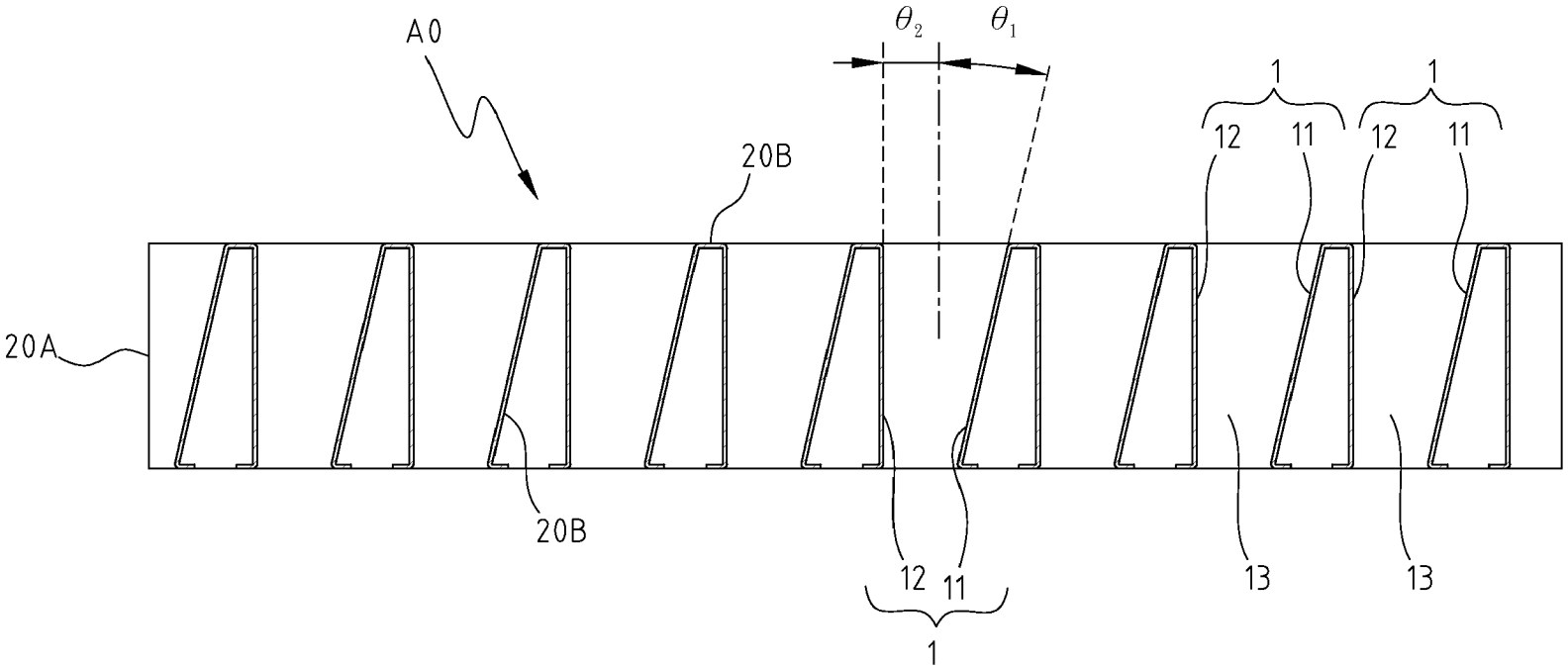
FIG. 2 shows a cross-sectional view of the AA side shown in FIG. 1.
Figure 3:
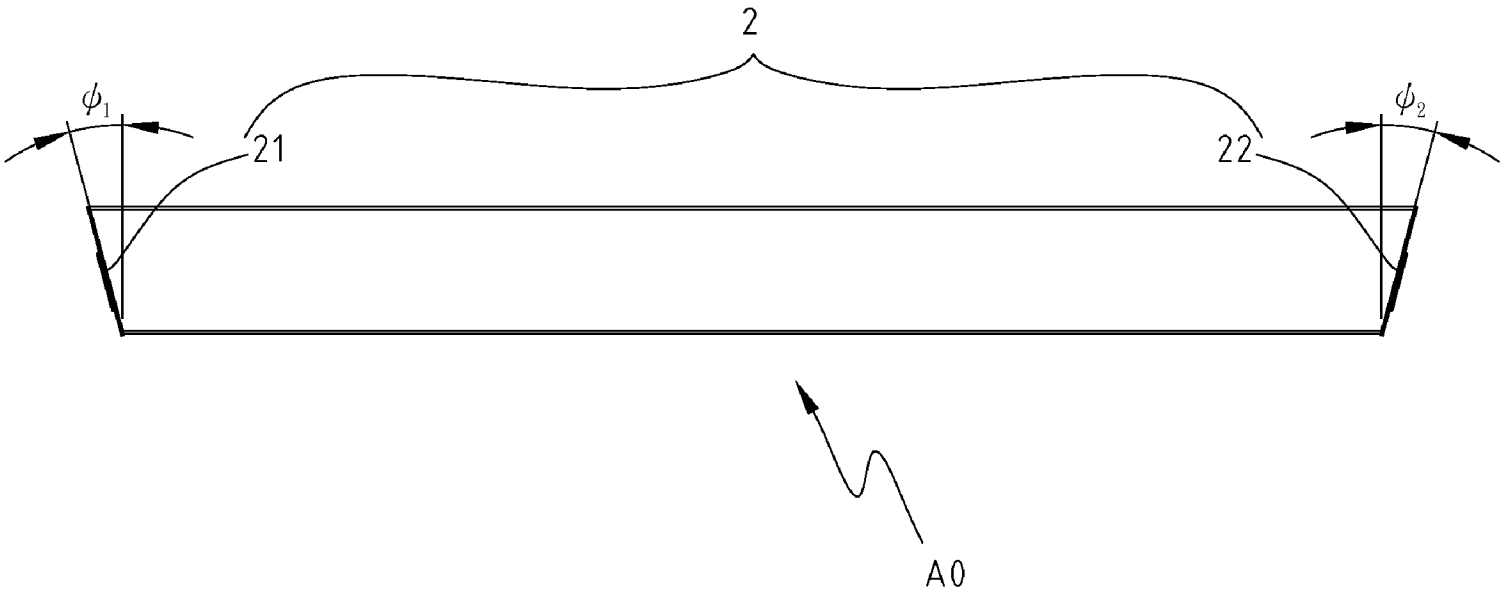
FIG. 3 shows a cross-sectional view of the BB side shown in FIG. 1.

FIG. 1 shows a schematic view of an optical module for LED array. An optical module A is applied to an LED array so that the light beam from the LED array can be guided and reflected by optical module A to achieve the target illuminance, brightness, luminance uniformity, coefficient of utilization, and luminaire efficiency within the lighted area. Optical module A includes at least a radiation guiding unit 1 and at least an anti-glare unit 2. The plurality of radiation guiding units 1 is arranged abreast. Each radiation guiding unit 1 includes a first reflector 11 and a second reflector 12, as shown in FIG. 2. First reflector 11 and second reflector 12 face each other. First reflector 11 forms an angle $\theta_1$ with the center line, and second reflector 12 forms an angle $\theta_2$ with the center line. Both $\theta_1$ and $\theta_2$ are within 0°–89°. In the present embodiment, $\theta_2$ is 0°. A space 13 exists between first reflector 11 and second reflector 12, serving as an area for light penetration and reflection. The light source is located at the bottom of space 13. The light source can be LED. As shown in FIG. 1 and FIG. 3, each anti-glare prevention unit 2 includes a first reflector 21 and a second reflector 22. First reflector 21 and second reflector 22 are located on the both sides of radiation pattern unit 1, respectively. First reflector 21 forms an angle $\phi_1$ with the center line, and second reflector 22 forms an angle $\phi_2$ with the center line. Both $\phi_1$ and $\phi_2$ are within 0°–89°. In the present embodiment, $\phi_1=\phi_2$.

FIG. 1 shows a schematic view of an optical module for an LED array. An optical module A0 is applied to an LED array so that the light beam from the LED array can be guided and reflected by optical module A0 to achieve the target illuminance, brightness, luminance uniformity, coefficient of utilization, and luminaire efficiency within the lighted area. Optical module A0 includes at least a radiation guiding unit 1 and at least an anti-glare unit 2. The plurality of radiation guiding units 1 is arranged abreast. Each radiation guiding unit 1 includes a first light guiding reflector 11 and a second light guiding reflector 12, as shown in FIG. 2. First light guiding 11 and a second light guiding reflector 12. The two sides of the plurality of light guiding plates 20B are engaged to anti-glare light reflecting plate 20A, respectively, to form optical module A0 of the present invention.

The main function of radiation guiding unit 1 is to reflect the light shedding on the ineffective area, e.g., the lateral direction of the road, to the effective area, e.g., along the traffic direction of the road, through first light guiding reflector 11 and second light guiding reflector 12. In other words, the concentric radiation pattern is adjusted to become a flat long stripe radiation pattern to match the lighted area shape. First light guiding reflector 11 and second light guiding reflector 12 can be either symmetric or asymmetric. The present embodiment uses asymmetric style, i.e., $\theta_1$ is not equal to $\theta_2$. The vertical heights and angles $\theta_1$, $\theta_2$ of first light guiding reflector 11 and second light guiding reflector 12 are determined by the traffic direction (tangent), road width (lateral), and the optical axis of the light source using a specific equation, combined with the location, the tilting angle, and the overhand of the lighting device, in order to generate a radiation pattern close to the two edges of the lighted area.

The main function of anti-glare unit 2 is to reflect the light shedding on the ineffective area, e.g., the lateral direction of the road, to the effective area, e.g., along the traffic direction of the road, through first anti-glare light reflector 21 and second anti-glare light reflector 22 to improve the coefficient of utilization and to prevent the glare in the road traffic direction which may interfere with the drivers. As shown in FIG. 1, the radiation guiding units 1 are disposed between the two elongated anti-glare light reflecting plates of the anti-glare unit 2 with the two ends of each radiation guiding unit 1 respectively engaged with the two elongated anti-glare light reflecting plates of the anti-glare unit 2.

To improve the luminaire efficiency, in the present embodiment, first light guiding reflector 11, second light guiding reflector 12, first anti-glare light reflector 21 and second anti-glare light reflector 22 have reflectivity higher than 85%. Therefore, first light guiding reflector 11, second light guiding reflector 12, first anti-glare light reflector 21 and second anti-glare light reflector 22 are all made of materials with high reflectivity, such as metal electroplated with silver or aluminum, whose reflectivity can reach as high as 95%, and the flux decay of each reflection is small.

Figure 4:
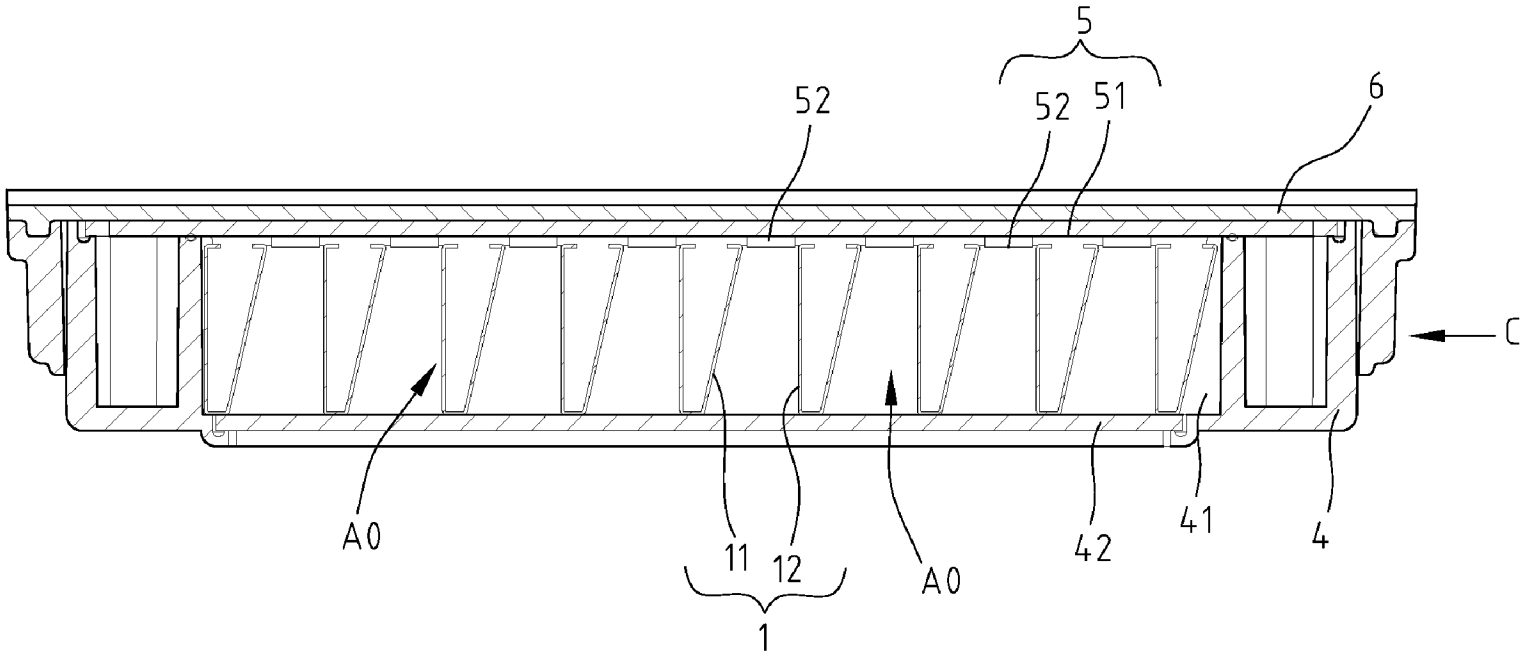
FIG. 4 shows a cross-sectional schematic view of a lighting device utilizing the optical module of the present invention.

FIG. 4 provides a schematic cross-sectional view of an actual application of the present invention in a luminaire. A light source C includes a light shell 4, an LED array 5, a heat-dissipation base 6, and optical module A0 of the present invention. The interior inside light shell 4 is a housing space 41 for housing LED array 5 and optical module A0. LED array 5 includes a circuit board 51 and a plurality of LEDs 52 arranged in a plurality of rows on circuit board 51. Each row of LEDs 52 corresponds to a radiation guiding unit 1 of optical module A0, and is located in the space between first light-guiding reflector 11 and second light-guiding reflector 12. Heat dissipation base 6 is attached to the back of LED array 5, and is engaged to light shell 4. Light shell 4 includes a lens 42, located on the light penetration path in front of optical module A0. Because light source C uses optical module A0 of the present invention, the radiation pattern, illuminance, brightness, luminance uniformity and coefficient of utilization are better than the conventional device.

The following example is provided for further explanation of the present invention. Take the street light as an example. The conventional lighted area for street light is not square. The ideal lighted area should be rectangular. The actual lighted area is adjusted according to the factors, such as, road width, pole distance, light height, and so on. In the present example, the conditions are as follows:

1. Road width is 6 m, light height 6 m, pole distance 18 m, installed single-sided.
2. The tilting angle of luminaire is 15°, overhand 0.78 m, traffic direction defined as X-axis, road width as Y-axis, pole located at the origin, i.e., (X=0, Y=0). Therefore, each luminaire is responsible for the area −9 m<=X<=9 m and 0 m<=Y<=6 m, which is the regulated lighted area.
3. The height of the radiation guiding unit of the optical module is 20 mm, with a flat shape. Angles $\theta_1$, $\theta_2$ of first reflector 11 and second reflector 12 of the radiation guiding unit are 12° and 7°, respectively. Angles $\phi_1$, $\phi_2$ of the anti-glare unit on both sides are both 0°. The optical module is made of highly reflective material, such as aluminum-plated or silver-plated metal, with reflectivity as high as 95%.
4. the radiation pattern of LED light source is Lambertian with a total of 1136 Lm.

Figure 5:
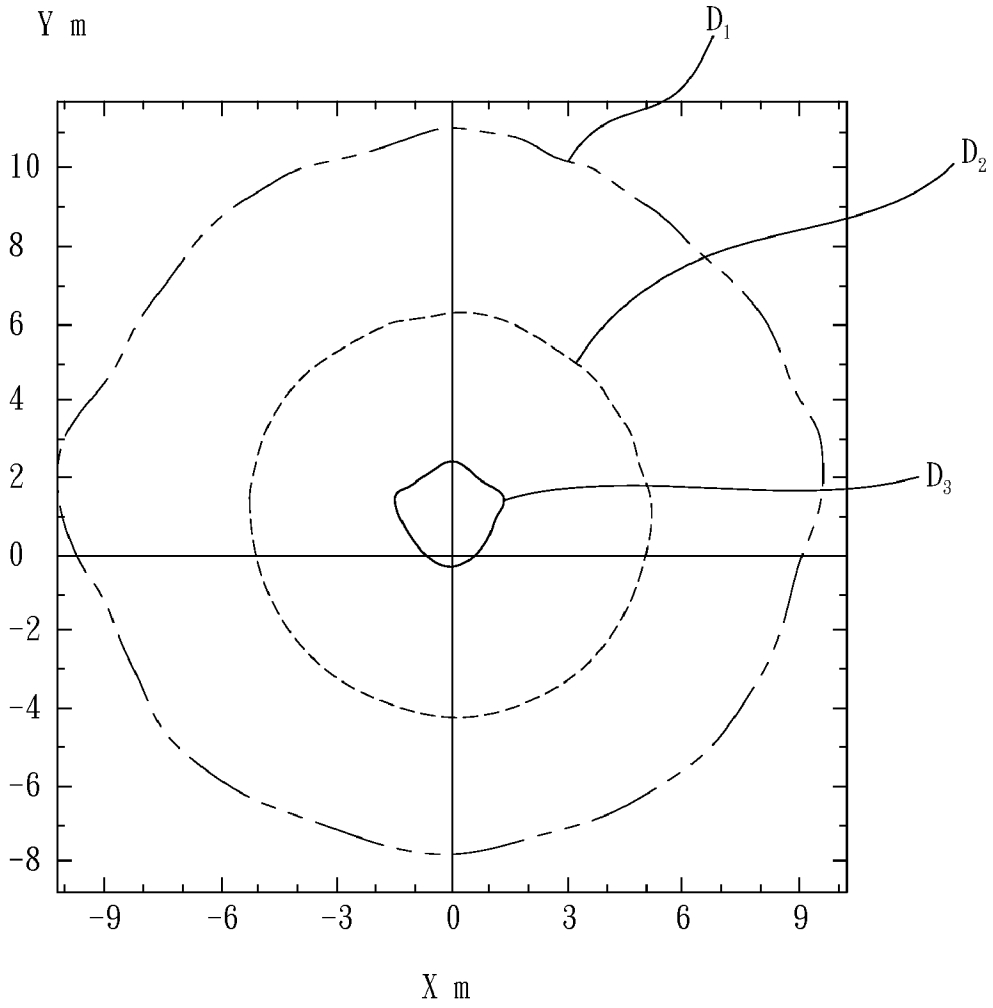
FIG. 5 shows a distribution curve of a street light without the optical module of the present invention.

FIG. 5 sows the illuminance distribution on the road surface by the street light without using the optical module of the present invention. The illuminance distribution is for a single street light. The maximum illuminance is 6.4 Lux. D1 is the distribution of equi-illuminance curve for 1 Lux, D2 is the distribution of equi-illuminance curve for 2 Lux, and D3 is the distribution of equi-illuminance curve for 6 Lux, the same for D1, D2 and D3 in FIGS. 6-7. The conventional street light without the optical module of the present invention has LED light source with axis-symmetric radiation pattern; therefore, the radiation pattern on the road surface is concentric. That is, a large amount of light beam sheds outside of the road (i.e., −6 m<=Y<=0 m), which is entirely wasted.

Figure 6:
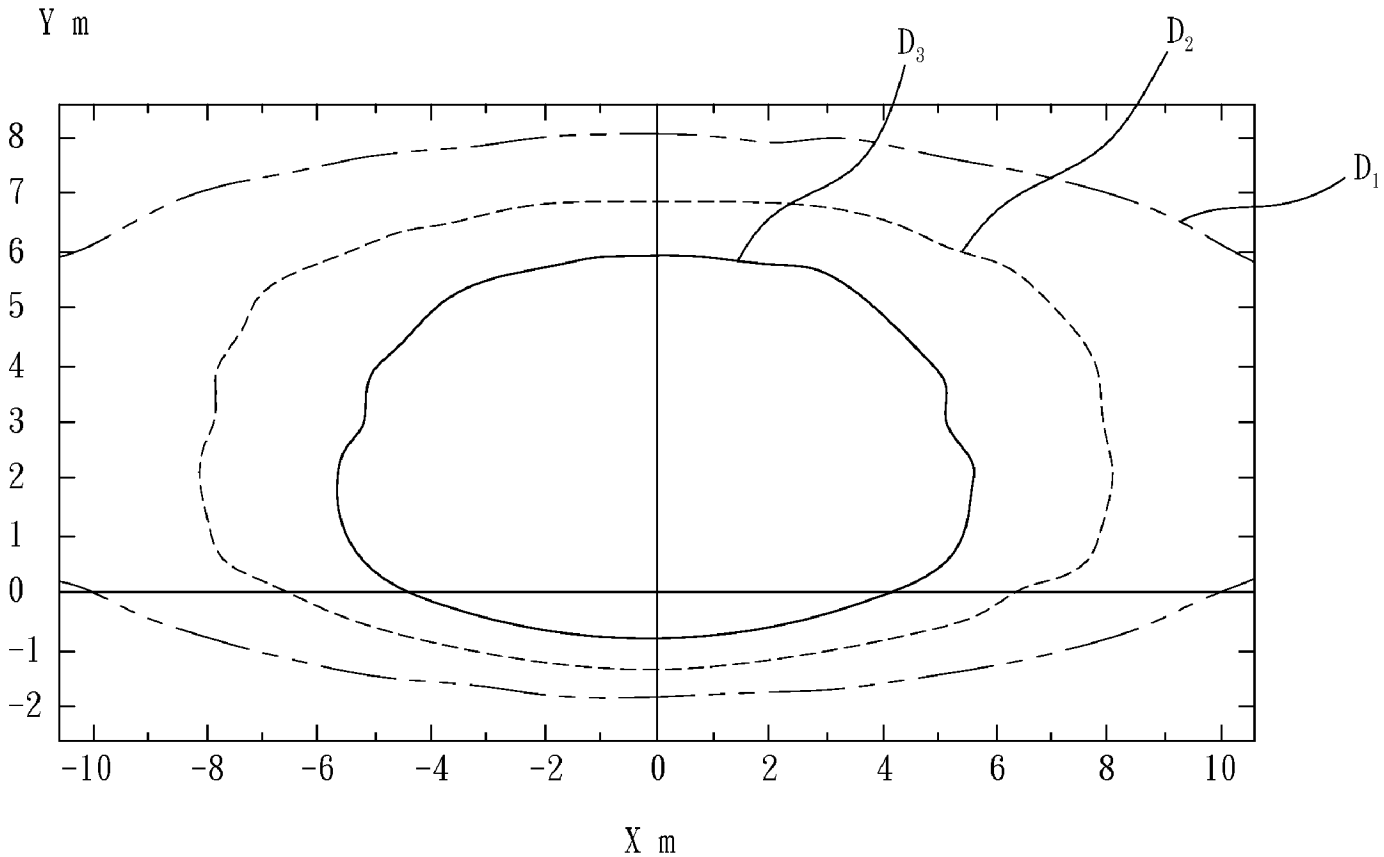
FIG. 6 shows a distribution curve of a street light utilizing the optical module of the present invention.

FIG. 6 shows the illuminance distribution on the road surface by the street light using the optical module of the present invention. The illuminance distribution is for a single street light. The maximum illuminance is 16.2 Lux. Because the optical module can effectively prevent light beam reflected outside the road. The range covered by the equi-illuminance for 6 Lux is greatly changed. The increase could be three times almost, i.e., from 6.4 Lux to 16.2 Lux. The distribution of the illuminance becomes an oval shape, which means the radiation pattern is closer to the lighted area shape, and the light source utilization is improved.

Figure 7:
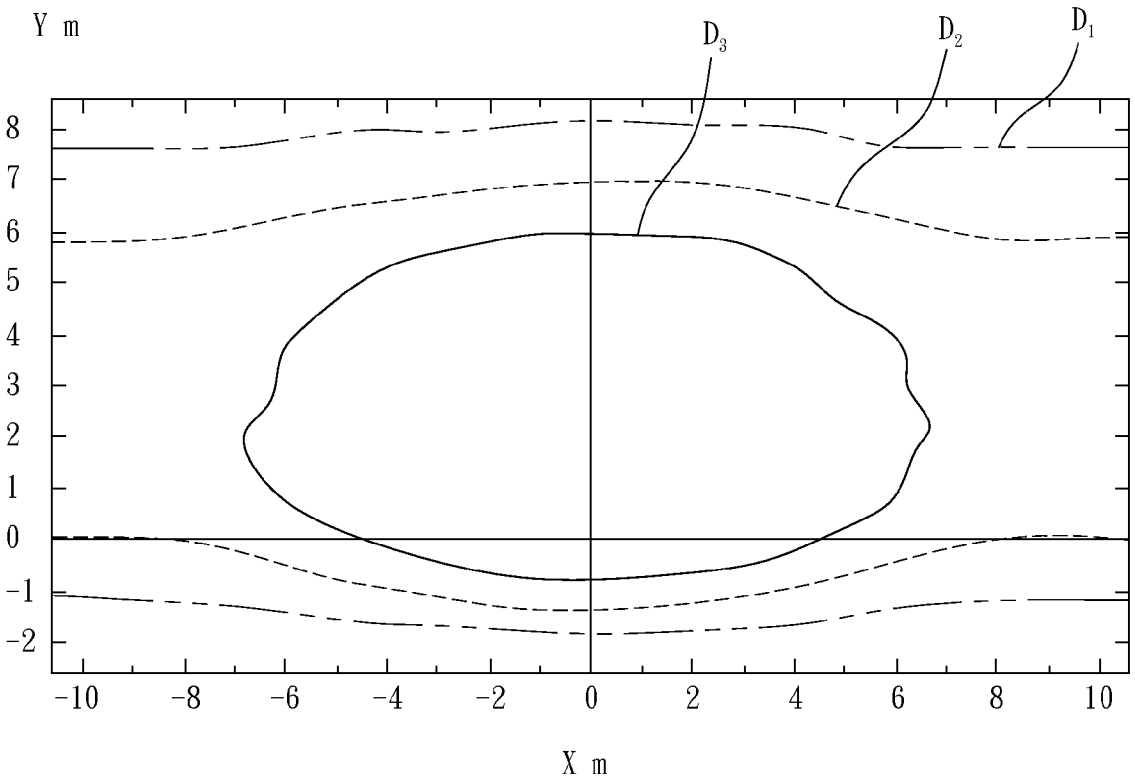
FIG. 7 shows a distribution curve of a street light utilizing the optical module of the present invention.

FIG. 7 shows the illuminance distribution on the road surface by using the optical module of the present invention. The illuminance distribution is resulted from three street lights. The left lamp is located at X=−18 m and Y=0 m. The right lamp is located at X=18 m and Y=0 m. The maximum illuminance is 16.6 Lux. As shown in FIG. 7, the radiation pattern is a long stripe that stays close to the edges of the road. The average illuminance is 8.3 Lux, which is more than twice of the 3.8 Lux for the lamps without the optical module of the present invention. The uniformity is 0.34, that just matches the code requirements, and the coefficient of utilization is 79%, much higher than the conventional 40-50%.

Figure 8A:
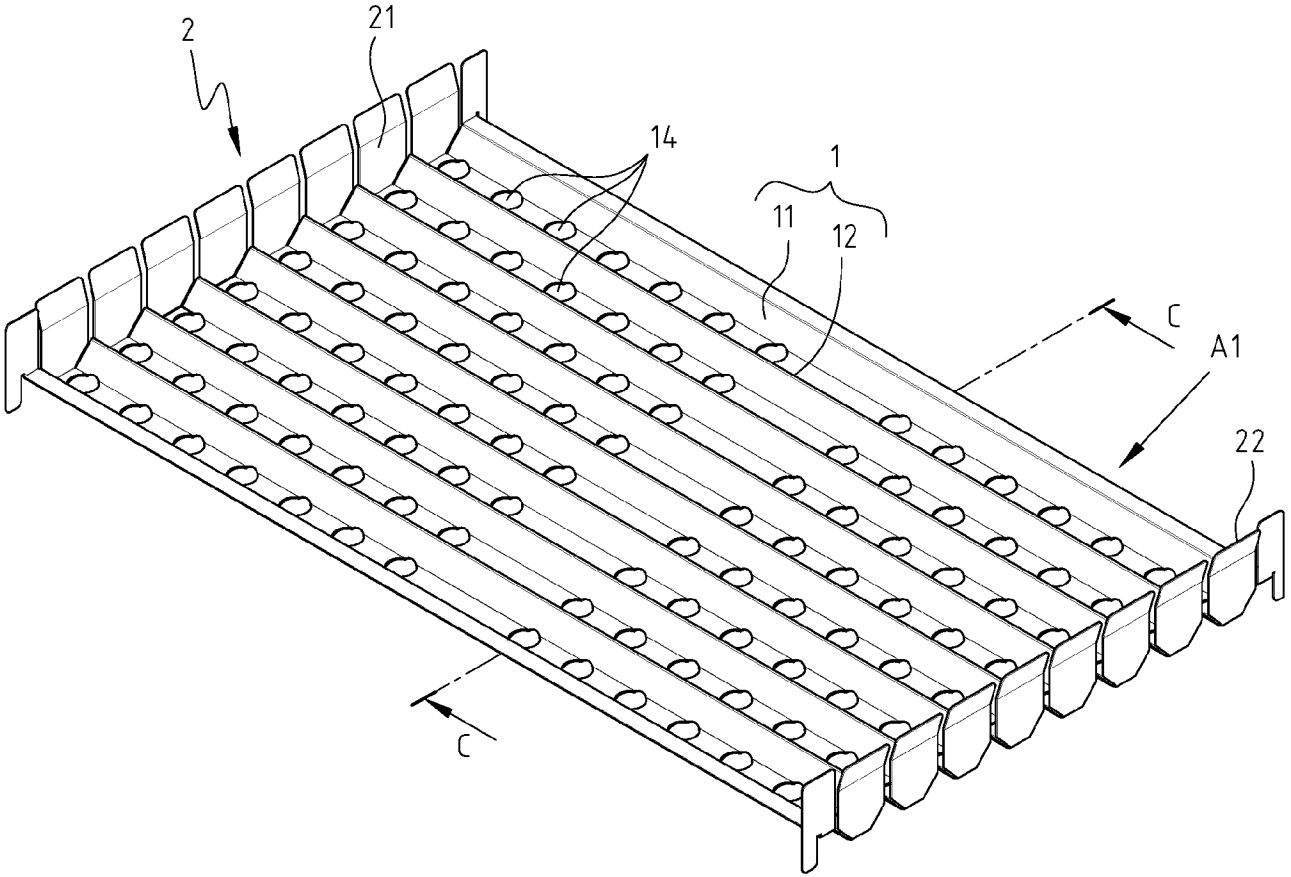
FIG. 8A shows a three-dimensional view of the second embodiment of the present invention.
Figure 8B:
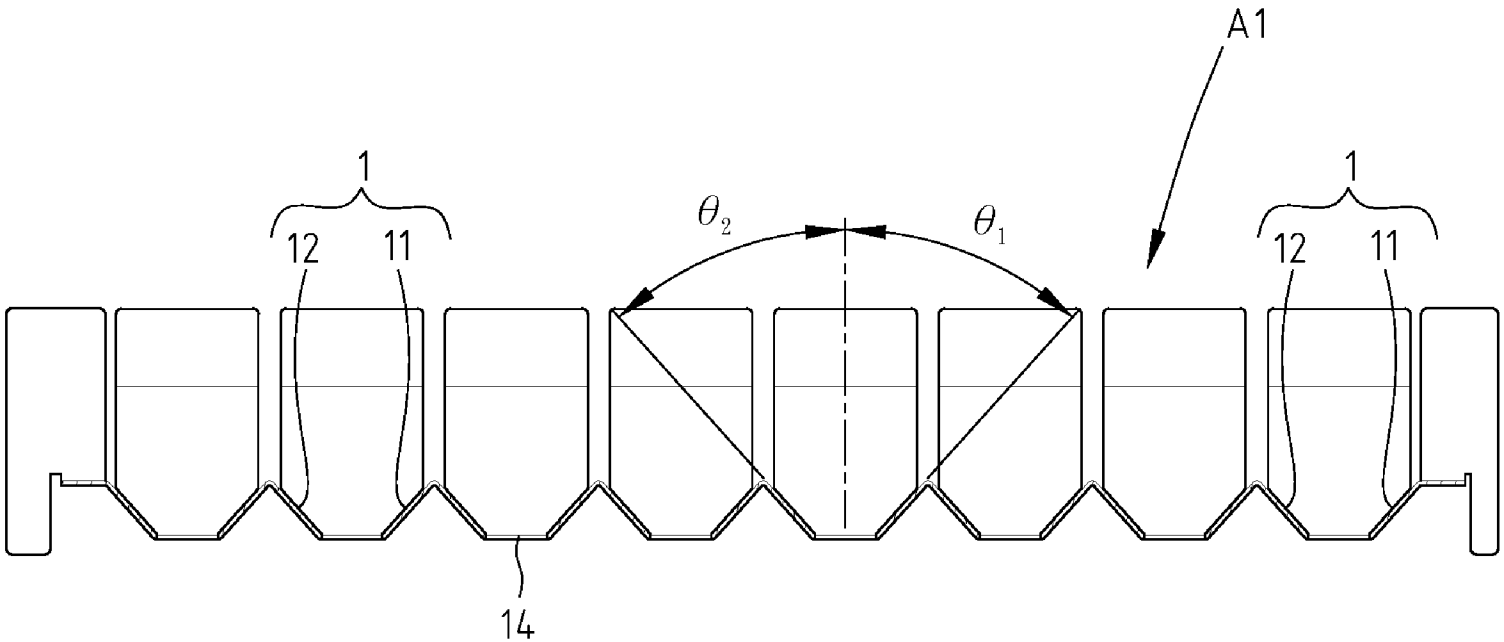
FIG. 8B shows a cross-sectional view of the second embodiment of the present invention.

The optical module of the present invention is not limited to certain shape or type. The following two embodiments show two different structures. FIGS. 8A and 8B show a three-dimensional and cross-section view of the second embodiment of the present invention, respectively. In the second embodiment, optical module A1 includes at least a radiation guiding unit 1 and at least a anti-glare unit 2. However, in this embodiment, first reflector 11 and second reflector 12 of radiation guiding unit 1 are symmetrically placed, i.e., $\theta_1=\theta_2$. In addition, there is a plurality of hole trenches 14 between first reflector 11 and second reflector 12 for placing LEDs. In this embodiment, the shape of hole trench 14 is circular, matching the shape of a single LED. Each radiation guiding unit 1 corresponds to a anti-glare unit 2. First reflector 21 and second reflector 22 are located on the both sides of the radiation guiding unit 1, respectively. Also, first reflector 21 forms two different tilting angles, and second reflector 22 also forms two different titling angles.

Figure 9:
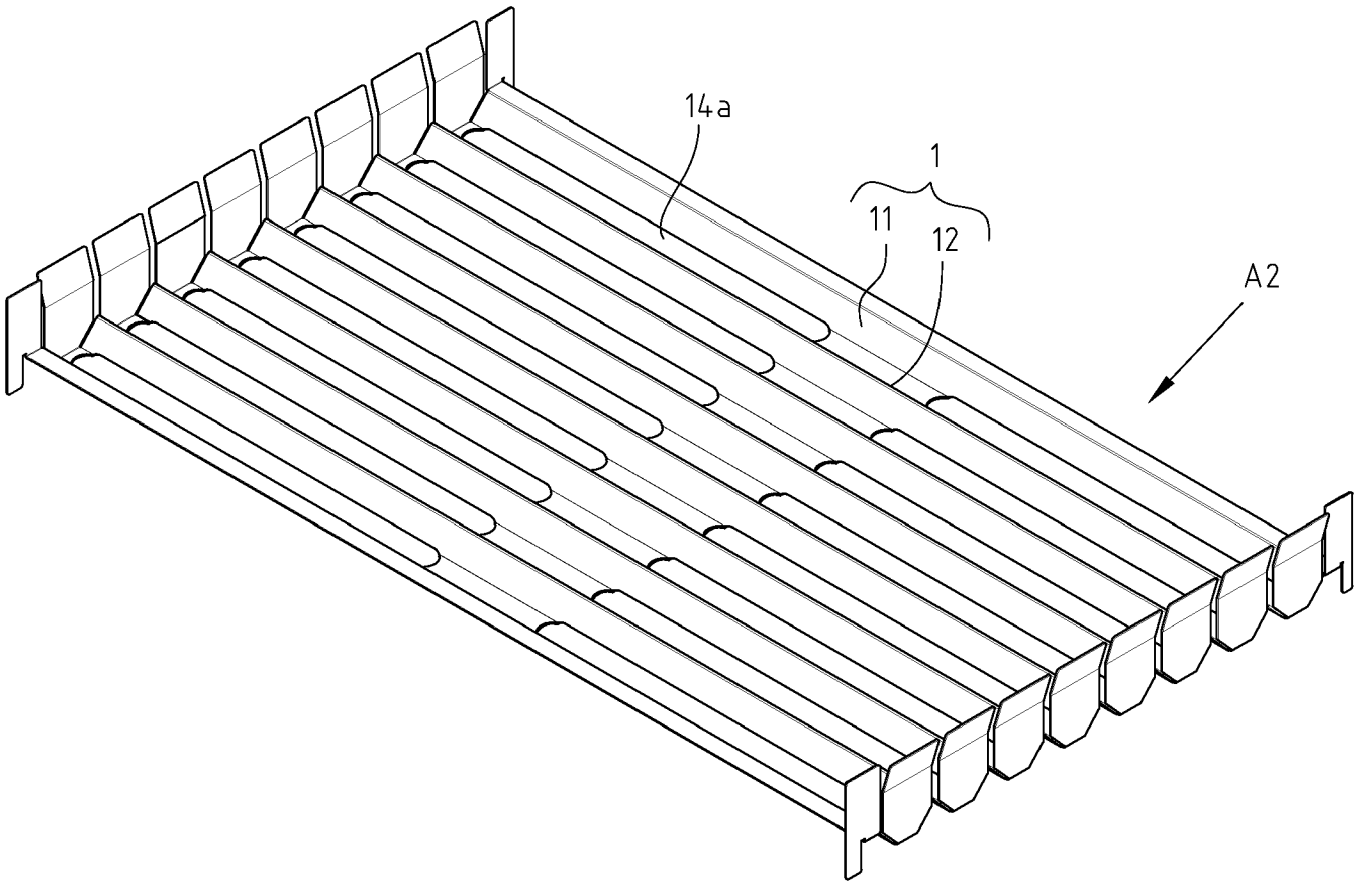
FIG. 9 shows a three-dimensional view of the third embodiment of the present invention.

FIG. 9 shows the third embodiment of the present invention. The third embodiment is similar to the second embodiment of FIG. 8A, except that hole trench 14A between first reflector 11 and second reflector 12 of optical module A2 of FIG. 9 is a long strip for placing a plurality of LEDs. Therefore, it is clear that the optical module of the present invention is not limited to any specific shape or type, and can be designed to match different needs.

In summary, the optical module of the present invention provides the following advantages:

1. The radiation pattern can be adjusted by lighted target's requirements, so as to achieve better coefficient of utilization
2. Prevent glare.
3. The present invention has a simple structure that can be easily redesigned to meet the application's need, such as road width, pole distance, luminaire height, and so on.
4. The reflector surfaces of the present invention are made of high reflective material so as to improve the coefficient of utilization and luminaire efficiency.

The reference description is one of the example only, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed:

1. An optical module for an LED light module used with an LED array, said optical module comprising:

a plurality of radiation guiding units, each of said radiation guiding units further comprising a first light guiding reflector and a second light guiding reflector, said two light guiding reflectors facing each other, said first light guiding reflector forming an angle $\theta_1$ with a center line between said first light guiding reflector and said second light guiding reflector, and said second light guiding reflector forming an angle $\theta_2$ with said center line, both $\theta_1$ and $\theta_2$ being within 0°-89°; and an anti-glare unit including a first anti-glare light reflector and a second anti-glare light reflector located respectively on two sides of said radiation guiding units, said first anti-glare light reflector forming an angle $\phi_1$ with said center line, and said second anti-glare light reflector forming an angle $\phi_2$ with said center line, both $\phi_1$ and $\phi_2$ being within +89° to −89°;

wherein said first and second anti-glare light reflectors are two elongated anti-glare light reflecting plates and said plurality of radiation guiding units are disposed between the two elongated anti-glare light reflecting plates with two ends of each radiation guiding unit being engaged respectively with the two elongated anti-glare light reflecting plates.

2. The optical module as claimed in claim 1, wherein said LED array further comprises a circuit board and a plurality of LEDs, said LEDs are arranged as a plurality of rows on said circuit board with each row of said LEDs corresponding to one of said radiation guiding units and located between said first light guiding reflector and said second light guiding reflector of the corresponding radiation guiding unit.

3. The optical module as claimed in claim 1, wherein said radiation guiding units are arranged abreast and are integrated with said anti-glare unit.

4. The optical module as claimed in claim 1, wherein said first light guiding reflector and said second light guiding reflector of each radiation guiding unit are asymmetric, and $\theta_1$ is unequal to $\theta_2$.

5. The optical module as claimed in claim 1, wherein said first light guiding reflector and said second light guiding reflector of each radiation guiding unit are symmetric, and $\theta_1$ is equal to $\theta_2$.

6. The optical module as claimed in claim 1, wherein the reflectivity of said first light guiding reflector and said second light guiding reflector is higher than 85%.

7. The optical module as claimed in claim 6, wherein said first light guiding reflector and said second light guiding reflector are electroplated with a layer of silver.

8. The optical module as claimed in claim 6, wherein said first light guiding reflector and said second light guiding reflector are electroplated with a layer of aluminum.

9. The optical module as claimed in claim 1, wherein a height of said first light guiding reflector and said second light guiding reflector is determined by an object to be lighted.

10. The optical module as claimed in claim 1, wherein $\theta_1$ and $\theta_2$ are determined by a coverage range of objects to be lighted.

11. The optical module as claimed in claim 1, wherein the reflectivity of said first anti-glare light reflector and said second anti-glare light reflector of said anti-glare unit is higher than 85%.

12. The optical module as claimed in claim 1, wherein a space exists between said first light guiding reflector and said second light guiding reflector of each of said radiation guiding units, and said space has a width determined by an objet to be lighted.

13. The optical module as claimed in claim 1, wherein a plurality of hole trenches are located between said first light guiding reflector and said second light guiding reflector of each of said radiation guiding units.

14. The optical module as claimed in claim 13, wherein each of said hole trenches is a long trench.

15. The optical module as claimed in claim 13, wherein each of said hole trenches is a round hole.

* * * * *